US007502583B2

(12) United States Patent
Sawai et al.

(10) Patent No.: US 7,502,583 B2
(45) Date of Patent: Mar. 10, 2009

(54) TRANSFER DEVICE AND IMAGE FORMING APPARATUS FOR ENHANCEMENT OF AN IMAGE STORED ON A RECORDING MEDIUM

(75) Inventors: Yuuji Sawai, Kanagawa (JP); Ryuuichi Minbu, Kanagawa (JP); Kazuchika Saeki, Saitama (JP); Atsushi Tano, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 11/207,730

(22) Filed: Aug. 22, 2005

(65) Prior Publication Data

US 2006/0056884 A1 Mar. 16, 2006

(30) Foreign Application Priority Data

Sep. 10, 2004 (JP) ..... 2004-263499

(51) Int. Cl.
*G03G 15/16* (2006.01)

(52) U.S. Cl. ..... 399/302; 399/308

(58) Field of Classification Search ..... 399/302, 399/308

See application file for complete search history.

(56) References Cited

U.S. PATENT DOCUMENTS 3,879,121 A * 4/1975 Simpson ..... 399/145
5,191,378 A * 3/1993 Itaya et al. ..... 399/313
5,442,428 A 8/1995 Takahashi et al.
5,701,566 A 12/1997 Bisaiji et al.
5,870,650 A 2/1999 Takahashi et al.
5,913,092 A 6/1999 Bisaiji et al.
5,950,062 A 9/1999 Yahata et al.
5,983,060 A 11/1999 Namekata et al.
5,999,776 A * 12/1999 Abe et al. ..... 399/176
6,006,062 A 12/1999 Takahashi et al.
6,035,157 A 3/2000 Takahashi et al.
6,163,675 A * 12/2000 Kido et al. ..... 399/313
6,205,299 B1 * 3/2001 Kusaka et al. ..... 399/45
6,223,008 B1 4/2001 Takahashi et al.
6,269,228 B1 7/2001 Kayahara et al.
6,349,192 B1 * 2/2002 Yoshino et al. ..... 399/302

(Continued)

FOREIGN PATENT DOCUMENTS

JP 07260848 A * 10/1995

(Continued)

OTHER PUBLICATIONS

U.S. Appl. No. 08/111,943, filed Aug. 26, 1993, Unknown.

(Continued)

*Primary Examiner*—Quana M Grainger
(74) *Attorney, Agent, or Firm*—Oblon, Spivak, McClelland, Maier & Neustadt, P.C.

(57) ABSTRACT

A transfer device includes an endless belt, an external roller, and an internal roller. The external roller is arranged outside of the loop of the endless belt and the inner roller is arranged inside of the loop of the endless belt. The endless belt is sandwiched between the external roller and the internal roller. A surface hardness of the external roller and a surface hardness of the internal roller are 50 degrees or more in an asker C scale. A logarithm (LogR) of volume resistivity of the intermediate transfer member is 10.0 or less.

13 Claims, 8 Drawing Sheets

U.S. PATENT DOCUMENTS

| | | | | |
|---|---|---|---|---|
| 6,445,900 | B2 | 9/2002 | Fukao et al. | |
| 6,505,024 | B2 | 1/2003 | Kayahara et al. | |
| RE38,206 | E | 7/2003 | Bisaiji et al. | |
| 6,611,672 | B2 | 8/2003 | Aoki et al. | |
| 6,618,565 | B2 | 9/2003 | Tamiya et al. | |
| 6,654,574 | B2 | 11/2003 | Kayahara et al. | |
| 6,690,905 | B2 | 2/2004 | Takahashi et al. | |
| 6,697,595 | B2 | 2/2004 | Kawagoe et al. | |
| 6,701,118 | B2 | 3/2004 | Kayahara et al. | |
| 6,741,821 | B2 | 5/2004 | Sugino et al. | |
| 6,785,500 | B2 | 8/2004 | Takahashi et al. | |
| 6,829,450 | B2 | 12/2004 | Tamiya et al. | |
| 6,868,248 | B2 | 3/2005 | Fukao et al. | |
| 6,901,234 | B2 | 5/2005 | Ogiyama et al. | |
| 7,127,201 | B2 * | 10/2006 | Takenouchi et al. | 399/297 |
| 2003/0044199 | A1 * | 3/2003 | Funabashi | 399/176 |
| 2003/0077091 | A1 * | 4/2003 | Takahata et al. | 399/302 |
| 2003/0118359 | A1 | 6/2003 | Ogiyama et al. | |
| 2003/0215269 | A1 | 11/2003 | Kayahara et al. | |
| 2004/0081488 | A1 * | 4/2004 | Yanagida et al. | 399/313 |
| 2004/0126156 | A1 * | 7/2004 | Stelter et al. | 399/313 |
| 2004/0228659 | A1 * | 11/2004 | Nishida | 399/176 |
| 2005/0063713 | A1 | 3/2005 | Watanabe et al. | |
| 2005/0169667 | A1 | 8/2005 | Katoh | |
| 2006/0056884 | A1 | 3/2006 | Sawai et al. | |

FOREIGN PATENT DOCUMENTS

| | | |
|---|---|---|
| JP | 3482802 | 10/2003 |

OTHER PUBLICATIONS

U.S. Appl. No. 11/207,730, filed Aug. 22, 2005, Sawai, et al.
U.S. Appl. No. 11/588,340, filed Oct. 27, 2006, Saeki, et al.
U.S. Appl. No. 11/608,599, filed Dec. 8, 2006, Sawai.
U.S. Appl. No. 11/739,391, filed Apr. 24, 2007, Yokokawa et al.
U.S. Appl. No. 11/748,511, filed May 15, 2007, Sawai, et al.
U.S. Appl. No. 11/757,661, filed Jun. 4, 2007, Sawai, et al.
U.S. Appl. No. 11/759,008, filed Jun. 6, 2007, Sawai.
U.S. Appl. No. 11/934,981, filed Nov. 5, 2007, Furuya, et al.
U.S. Appl. No. 12/163,012, filed Jun. 27, 2008, Endou, et al.

* cited by examiner

TRANSFER DEVICE AND IMAGE FORMING APPARATUS FOR ENHANCEMENT OF AN IMAGE STORED ON A RECORDING MEDIUM

CROSS-REFERENCE TO RELATED APPLICATIONS

The present document incorporates by reference the entire contents of Japanese priority document, 2004-263499 filed in Japan on Sep. 10, 2004.

BACKGROUND OF THE INVENTION

1. Field of the Invention

The present invention relates to a transfer device, which transfers a toner image formed on an image bearing member onto a recording medium via an intermediate transfer member, and an image forming apparatus including the transfer device.

2. Description of the Related Art

A conventional image forming apparatus is disclosed in Japanese Patent No. 3482802 (Japanese Patent Application Laid-Open No. H10-254262).

The conventional image forming apparatus had a problem in that spot-like irregularities occur in an image. Such irregularities include, for example, white spots. The white spot is a phenomenon in which a white void of a white dot or white speck shape with a diameter of 0.1 to 0.3 millimeter is caused in a solid portion because of spot-like discharge in a secondary transfer nip.

SUMMARY OF THE INVENTION

It is an object of the present invention to at least solve the problems in the conventional technology.

A transfer device according to one aspect of the present invention includes a loop-shaped intermediate transfer member configured to hold a toner image, wherein a logarithm (LogR) of volume resistivity of the intermediate transfer member is 10.0 or less; an external roller that is arranged outside of a loop of the intermediate transfer member and that is configured to hold a recording medium in cooperation with the intermediate transfer member, wherein a surface hardness of the external roller is 50 degrees or more in an asker C scale; and an internal roller that is arranged inside of the loop of the intermediate transfer member and that is configured to hold the intermediate transfer member in cooperation with the external roller, wherein a surface hardness of the internal roller is 50 degrees or more in an asker C scale.

An image forming apparatus according to another aspect of the present invention includes a transfer device according to the present invention.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below in detail with reference to the accompanying drawings.

Figure 1:
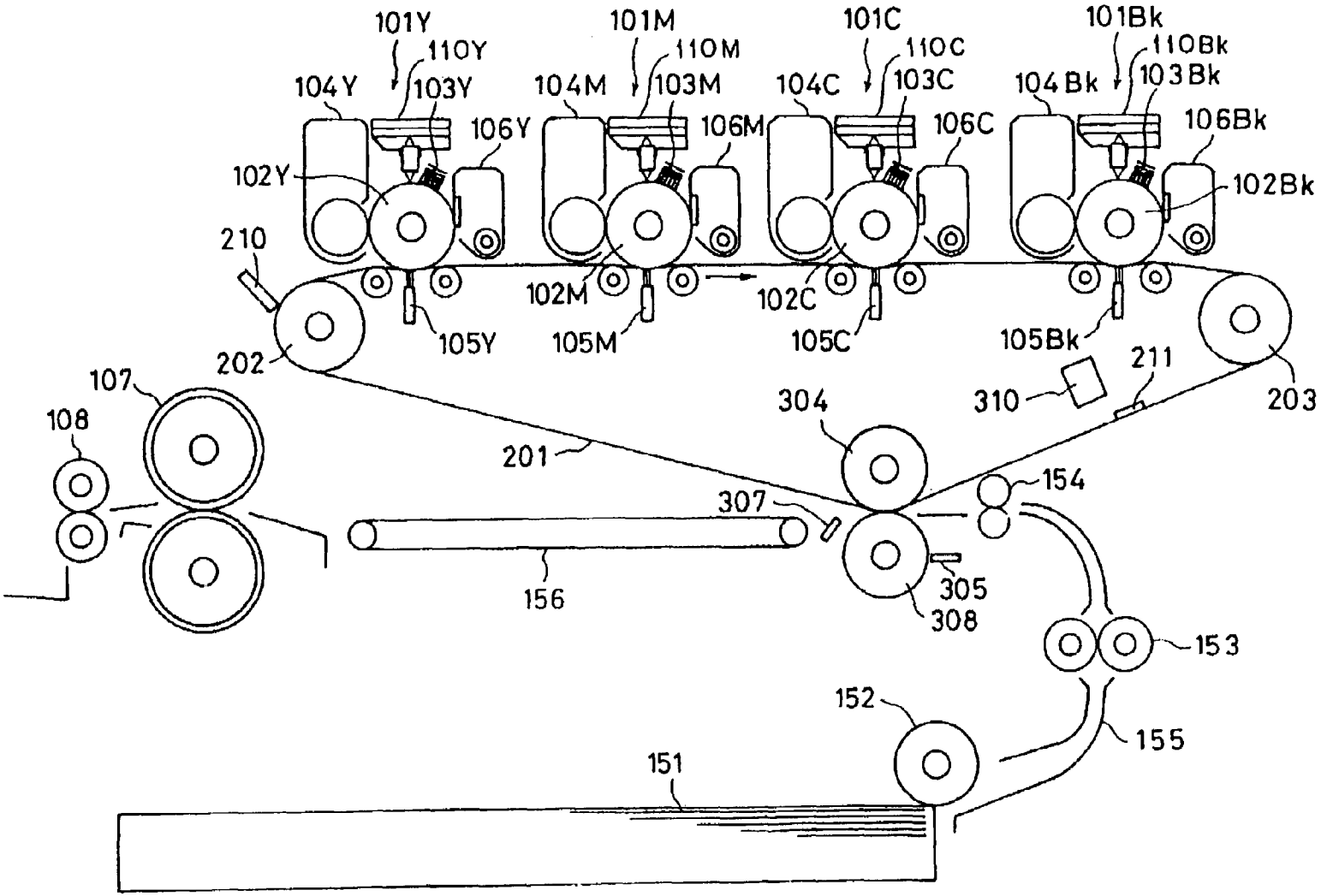
FIG. 1 is a schematic of an image forming apparatus according to a first embodiment of the present invention.

FIG. 1 is a schematic of an image forming apparatus according to a first embodiment of the present invention. The image forming apparatus employs a tandem type indirect transfer system. In other words, the image forming apparatus includes a plurality of image forming units 101Y to 101Bk that are disposed along an intermediate transfer member 201. The image forming apparatus includes a transfer device that includes an intermediate transfer member, which is an endless belt, (an intermediate transfer belt) 201. The intermediate transfer member 201 is wound around a plurality of support rollers and is rotationally conveyable clockwise in the figure.

An intermediate transfer member cleaning device 210, which removes a residual toner remaining on the intermediate transfer member 201 after image transfer, is provided on the left side of a first support roller 202 in the figure. Four image forming units 101Y, 101M, 101C, and 101Bk for colors yellow (Y), magenta (M), cyan (C), and black (Bk) are arranged side by side on the intermediate transfer member 201, which is extended between the first support roller 202 and a second support roller 203, along a conveying direction of the intermediate transfer member 201. The image forming units 101Y, 101M, 101C, and 101Bk constitute a tandem type image forming unit. The image forming units 101Y, 101M, 101C, and 101Bk of the tandem type image forming apparatus have substantially the same constitution, for example, as shown in FIG. 2.

Figure 2:
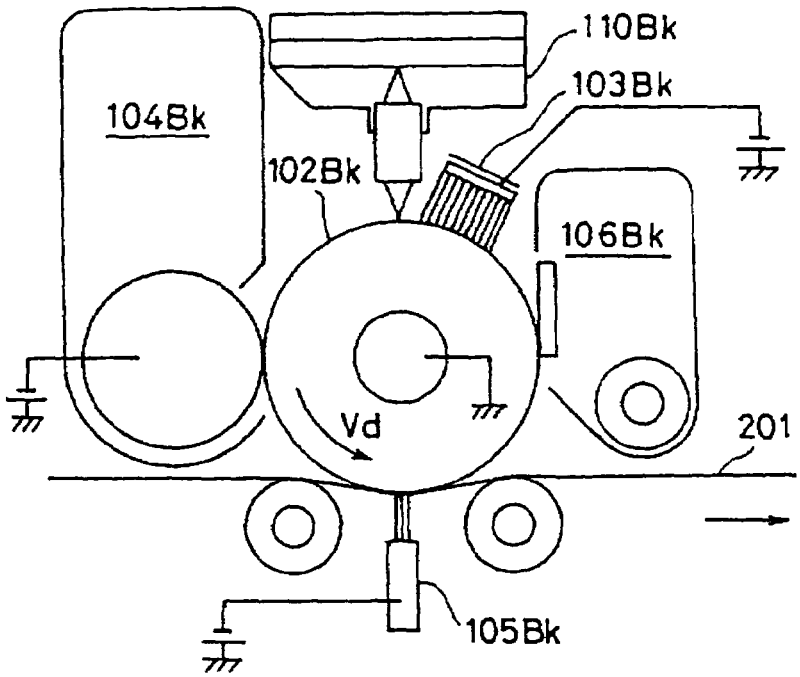
FIG. 2 is a schematic of an example of a constitution of an image forming unit in the image forming apparatus shown in FIG. 1.

FIG. 2 is a schematic of the image forming unit 101Bk for black (Bk) as an example. The image forming unit 101Bk includes a drum-like photosensitive member 102Bk serving as an image bearing member, a charging device 103Bk constituting image forming means for forming a toner image on the photosensitive member, an exposing device 110Bk, and a developing device 104Bk.

The charging device 103Bk uniformly charges the photosensitive member 102Bk. For example, the charging device 103Bk can be a charging brush, a charging roller, an electrifying charger, or the like.

The exposing device 110Bk is an exposing device of an LED writing system including a light-emitting diode (LED) array and a lens array arranged in an axial direction (a main scanning direction) of the photosensitive member 102Bk in the example shown in the figure. The exposing device 110Bk forms an electrostatic latent image on the photosensitive member 102Bk. Other than this exposing device, it is also possible to use an exposing device of a laser scanning system including a laser beam source, a light deflector (a rotary polygon mirror, etc.), and an imaging scanning optical system.

The developing device 104Bk includes a developing roller (or a developing sleeve) that rotates while carrying a developer and an agitating/carrying member that agitates the developer and carries the developer to the developing roller (or the developing sleeve). The developing device 104Bk develops an electrostatic latent image formed on the photosensitive member 102Bk with a toner of the developer to visualize the electrostatic latent image. As the developer, a one-component developer consisting of only a toner or a two-component developer consisting of a toner and a magnetic carrier is used. Note that, since the image forming unit 101Bk shown in FIG. 2 is an example of an image forming unit for black (Bk), a black toner is used as the toner. In the image forming units 101Y, 101M, and 101C of the other colors shown in FIG. 1, toners of yellow (Y), magenta (M), and cyan (C) are used, respectively.

A toner image formed on the photosensitive member 102Bk through charging, exposure, and development is transferred onto the intermediate transfer member 201 in a primary transfer unit. A transfer brush 105Bk serving as primary transfer means is disposed in a position of the primary transfer unit opposed to the photosensitive member 102Bk across the intermediate transfer member 201. A transfer bias is applied to the transfer brush 105Bk by a DC power supply. A photosensitive member cleaning device 106Bk for removing a residual toner remaining on the photosensitive member 102Bk after image transfer is provided on a downstream side of the primary transfer unit in a rotating direction of the photosensitive member 102Bk.

The image forming unit 101Bk for black (Bk) has been explained as an example. The other image forming units 101Y, 101M, and 101C for yellow (Y), magenta (M), and cyan (C) are constituted in the same manner. In FIG. 1, the same components are denoted by the same reference numerals. Signs Y, M, C, and Bk are attached to the ends of the respective numbers to distinguish the colors.

In the tandem type image forming unit explained above, in forming a color image, the image forming units 101Y, 101M, 101C, and 101Bk for yellow (Y), magenta (M), cyan (C), and black (Bk) form toner images of yellow (y), magenta (M), cyan (C), and black (Bk) on the photosensitive members 102Y, 102M, 102C, and 102Bk, respectively. The image forming units 101Y, 101M, 101C, and 101Bk transfer the toner images onto the intermediate transfer member 201 such that the toner images are superimposed one on top of another to form a color image. In forming a black and white image, only the image forming unit 101Bk for black forms an image and transfers the image onto the intermediate transfer member 201.

On the other hand, a secondary transfer unit is provided on a side opposed to the tandem type image forming apparatus across the intermediate transfer member 201. The secondary transfer member includes a secondary transfer roller 308 serving as an external roller, a cleaning blade 305, and a charge eliminating needle 307. The secondary transfer roller 308 serving as the external roller is arranged to be pressed against a third support roller 304 serving as an internal roller via the intermediate transfer member 201. The secondary transfer roller 308 transfers a toner image on the intermediate transfer member 201 onto a recording medium such as a sheet. A sheet feeding unit including a sheet feeding cassette 151 and a sheet feeding roller 152, a sheet feeding path 155 having a sheet feeding roller 153, and a registration roller 154 are provided on an upstream side of the secondary transfer unit in a conveying direction of the recording medium. A conveying unit 156 that conveys a recording medium having an image transferred thereon, a fixing device 107 that fixes the transferred image on the recording medium, and a sheet discharging roller 108 that discharges the recording medium after fixing to a sheet discharging unit are provided on a downstream side of the secondary transfer unit.

When a start switch of a not-shown operation unit is pressed, one of the support rollers 202, 203, and 304 is driven to rotate by a not-shown driving motor. At the same time, the other two support rollers are rotated following the rotation of the one support roller, whereby the intermediate transfer member (the intermediate transfer belt) 201 is rotated to be conveyed. At the same time, the photosensitive members 102Y, 102M, 102C, and 102Bk serving as image bearing members are rotated in the image forming units 101Y, 101M, 101C, 101Bk of the respective colors. Single color images of yellow, magenta, cyan, and black are formed on the photosensitive members 102Y, 102M, 102C, and 102Bk, respectively. According to the conveyance of the intermediate transfer member 201, the single color images are sequentially transferred onto the intermediate transfer member 201 to be superimposed one on top of another in the primary transfer unit. Consequently, a combined color image is formed on the intermediate transfer member 201.

When the start switch is pressed, the sheet feeding roller 152 is rotated and a sheet-like recording medium such as paper is sent out from the sheet feeding cassette 151 and guided to the sheet feeding path 155. Then, the recording medium is brought into abutment against the registration roller 154 and stopped.

Thereafter, the registration roller 154 is rotated to be timed to coincide with the combined color image on the intermediate transfer member 201. The recording medium is sent into a space between the intermediate transfer member 201 and the secondary transfer roller (an external roller) 308 of the secondary transfer unit. Then, the color image is transferred onto the recording medium according to the transfer by the secondary transfer roller 308.

Figure 3:
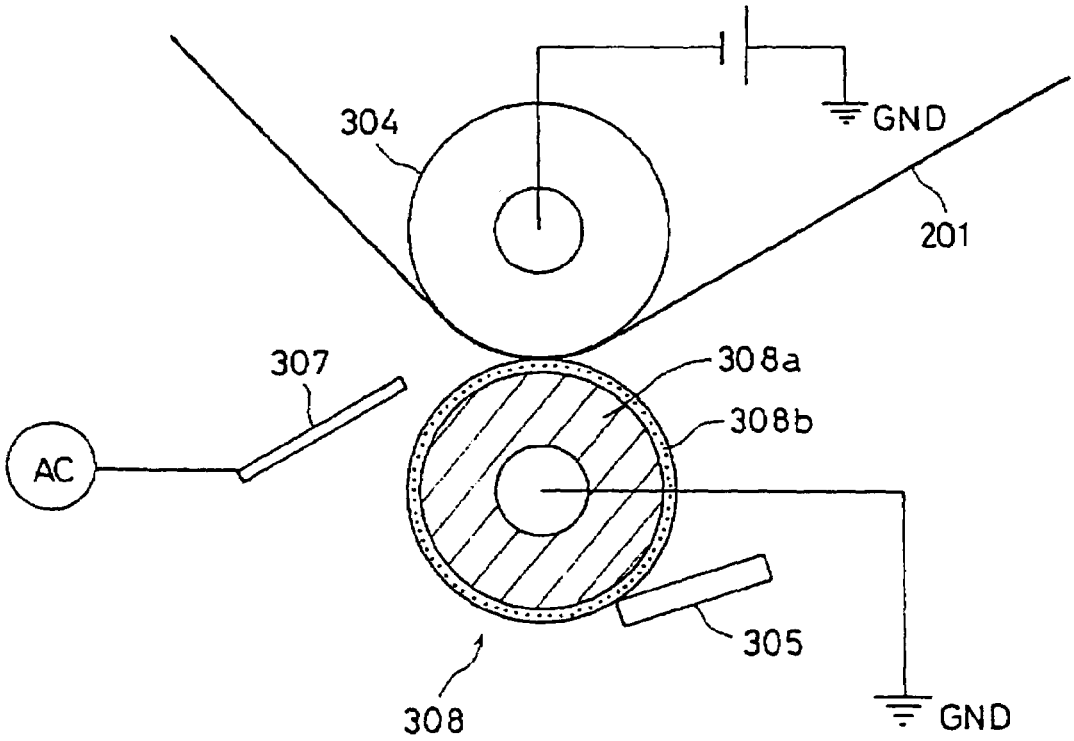
FIG. 3 is a schematic of an example of a constitution of a secondary transfer unit in the image forming apparatus shown in FIG. 1.

As shown in FIG. 3, the internal roller 304 is arranged on the inner side of the intermediate transfer member 201 to be opposed to the secondary transfer roller (the external roller) 308. A bias with the same polarity as the toner is applied (in this embodiment, since the toner is charged negatively (−), a negative (−) bias voltage is applied) to the internal roller 304 by the DC power supply to transfer the toner onto the recording medium. The secondary transfer roller (the external roller) 308 is grounded.

The recording medium, with the image transferred thereon, is conveyed by the conveying unit 156 and sent into the fixing device 107. Heat and pressure are applied to the recording medium and the transferred image is fixed on the recording medium by the fixing device 107. Then, the recording medium is stacked on a not-shown sheet discharge tray of the sheet discharging unit.

On the other hand, after the image transfer, a residual toner remaining on the intermediate transfer member 201 after the image transfer is removed by the intermediate transfer member cleaning device 210. The intermediate transfer member 201 is prepared for the next image formation to be performed by the tandem image forming units 101Y to 101Bk.

Note that the logarithm (LogR) of volume resistivity for resistance of the intermediate transfer member 201 is set to 10.0 or less such that a stable transfer image without a problem of a residual image due to residual potential is obtained.

The secondary transfer roller 308 of the secondary transfer unit is in contact with the intermediate transfer member 201. Thus, a portion of the secondary transfer roller 308 where a recording medium such as a transfer sheet is not placed or between sheets, stain of a toner stuck to the intermediate transfer member 201, a pattern for process control, or the like is transferred onto the portion to stain the secondary transfer roller 308. Therefore, the secondary transfer roller 308 is formed in a two layer structure. For example, a surface layer 308*b* is coated on a rubber layer 308*a*, and the surface layer 308*b* consists of fluorine resin with high releasability to obtain a cleaning property. A toner on the secondary transfer roller 308 is removed by the secondary transfer cleaning blade 305.

The charge eliminating needle 307 is provided on a downstream side of the secondary transfer unit. An alternating current is applied to a recording medium from a rear surface thereof by the charge eliminating needle 307 to neutralize accumulated charge (eliminate charge) of the recording medium. Consequently, the recording medium, with the image transferred thereon, is prevented from winding around the intermediate transfer member 201. In other words, a recording medium after secondary transfer adheres to the intermediate transfer member 201 and does not peel off easily.

The examples of the constitutions of the transfer device and the image forming apparatus according to the present invention have been explained. In this embodiment, in the transfer device and the image forming apparatus having the constitutions described above, both surface hardness of the secondary transfer roller (the external roller) 308 and surface hardness of the internal roller 304 are set to 50 degrees or more in the asker C scale and the logarithm (LogR) of volume resistivity of the intermediate transfer member 201 is set to 10.0 or less. Moreover, in this embodiment, the logarithm (LogR) of combined resistance of the secondary transfer roller (the external roller) 308 and the internal roller 304 is set to 6.5 or more and the logarithm (LogR) of an amount of change in surface resistance of the secondary transfer roller (the external roller) 308 or the internal roller 304 is set to 0.4 or less.

Since the surface hardness of the external roller 308 is set in this way, it is possible to remove a residual toner on the external roller 308 easily. Consequently, possibility of occurrence of spot-like irregularity is reduced. In addition, since the surface hardness is increased, it is possible to increase a transfer pressure. Consequently, spot-like irregularity of an image due to thick paper or an uneven recording medium is reduced. Moreover, in a roller with high surface hardness, it is possible to reduce permanent deformation (an amount of deformation is small), which is advantageous for preventing deformation of the roller. Therefore, a transfer property tends to be stable continuously.

It is possible to use the blade 305 for surface cleaning for the secondary transfer roller (the external roller) 308. Therefore, compared with an electrostatic cleaning system, it is unnecessary to provide an approaching/separating mechanism. High-performance cleaning, which does not require a user to take into account timing for cleaning, is realized. Note that, when surface hardness falls to 50 degrees or less in the asker C scale, a cleaning blade easily cuts into a roller surface because of abutment of the cleaning blade, making it impossible to obtain a proper cleaning angle. As a result, cleaning failure tends to occur.

Since surface hardness of the internal roller 304 is set to 50 degrees (in the asker C scale) or more, it is possible to reduce fluctuation in speed of the intermediate transfer member 201 in a transfer nip. Consequently, spot-like irregularity of an image due to the fluctuation in speed of the intermediate transfer member 201 is reduced.

Moreover, since the logarithm (LogR) of volume resistivity of the intermediate transfer member 201 is set to 10.0 or less, it is possible to reduce residual potential of the intermediate transfer member 201. Consequently, it is possible to reduce spot-like irregularity of an image due to residual potential of the intermediate transfer member 201.

However, on the other hand, in the transfer device in which the logarithm (LogR) of volume resistivity of the intermediate transfer member 201 is set to 10.0 or less, a high voltage tends to be applied on a recording medium. In the transfer device using a roller with high surface hardness, transfer failure tends to occur because of a reduction in the transfer nip and non-uniformity of a transfer pressure. As a result, a transfer voltage is set higher to improve the transfer property.

When sheet resistance increases because of a low humidity environment or at the time of rear side copying in duplex copying or the like, the transfer voltage increases more. As a result, it is likely that spot-like discharge occurs in a solid image portion and white void (white spot) with a diameter of about 0.1 to 0.3 millimeter occurs.

Combined resistance of the secondary transfer roller (the external roller) 308 and the internal roller 304 is important in designing a transfer system. When the logarithm (LogR) of combined resistance is 6.5 or less, an electric current flowing to a sheet changes depending on a sheet size.

When a small size sheet such as an A5 size sheet is used, an electric current tends to flow directly from the secondary transfer roller 308 to a non-paper-passing section of the intermediate transfer member 201. Since a required effective transfer electric field is not obtained, transfer failure tends to occur in an image. Thus, the logarithm (LogR) of combined resistance is set to 6.5 or more. Consequently, even if a small size sheet is used, since an electric current flowing to the non-paper-passing section does not increase excessively, an appropriate transfer electric field is obtained and a satisfactory image is obtained.

In a roller such as the secondary transfer roller 308 shown in FIG. 3 in which the surface of the rubber layer 308*a* is coated with the high-resistance thin layer 308*b*, conventionally, resistance of a surface of the roller has been measured according to surface resistance measurement. However, since measurement of surface resistance includes measurement of rubber layer resistance, it is impossible to measure surface layer resistance correctly.

Surface layer material coating may be applied to a metal plate to perform property management according to surface resistivity and volume resistivity. However, resistance of the thin layer coated on the roller surface and resistance of the thin layer coated on the metal plate are not always identical. This causes fluctuation in resistance of the roller surface resistance.

As a result of the researches and developments conducted by the inventors, it has been found that it is possible to evaluate a surface thin layer resistance correctly according to an amount of change in surface resistance.

When the logarithm (LogR) of an amount of change in surface resistance of the secondary transfer roller (the external roller) 308 is 0.4 or more, an effect of prevention of white spot is high. However, the residual potential increases because of an increase in surface layer resistance and the transfer property deteriorates successively because of continuous copying (printing). On the other hand, since the logarithm (LogR) of an amount of change in surface resistance is set to 0.4 or less, the deterioration of the transfer property due to an increase in roller potential does not occur and it is possible to prevent spot-like discharge and occurrence of white spot.

Therefore, the logarithm (LogR) of combined resistance of the secondary transfer roller (the external roller) 308 and the internal roller 305 is set to 6.5 or more and the logarithm (LogR) of an amount of change in surface resistance is set to 0.4 or less. Consequently, transfer failure due to a sheet size does not occur and it is possible to prevent occurrence of spot-like discharge during sheet transfer and reduce occurrence of white spot in a toner image.

Note that both the surface hardness of the secondary transfer roller (the external roller) 308 and the surface hardness of the internal roller 304 are set to 50 degree or more in the asker C scale. Thus, it is possible to set an abutment pressure in blade cleaning appropriately. In addition, stain on a rear side of a sheet due to cleaning failure does not occur and it is possible to reduce occurrence of white spot.

The logarithm (LogR) of volume resistance of the intermediate transfer member 201 is 7.5 or more. Therefore, it is possible to prevent occurrence of transfer failure due to an increase in residual potential and reduce occurrence of white spot.

On the other hand, when the logarithm (LogR) of volume resistance of the intermediate transfer member 201 falls to 7.5 or less, a transfer current tends to flow to the intermediate transfer member 201. Therefore, when transfer electric field control is constant voltage control, a power supply capacity increases because of an increase in an electric current to cause an increase in cost for a power supply. When transfer electric field control is constant current control, since a power supply voltage falls, it is likely that a required transfer electric field cannot be obtained. In addition, since an electric current tends to flow in a plane direction of the intermediate transfer member 201, the electric current flows to a member near the intermediate transfer member 201 (a roller, etc.) to cause fluctuation in a transfer current easily.

The logarithm (LogR) of combined resistance of the secondary transfer roller (the external roller) 308 and the internal roller 304 is set to 9.0 or less. Therefore, it is possible to prevent an increase in a transfer voltage. In addition, it is possible to prevent insufficiency of a power supply voltage and leakage due to a high voltage and reduce occurrence of white spot. Note that, when the logarithm (LogR) of combined resistance is set to 9.0 or more, a transfer voltage increases. In particular, in the case of thick paper, duplex copying, low temperature and low humidity, and the like, the transfer voltage increases more. Thus, it is more likely that an image with insufficient transfer of a toner is formed, white spot occurs, and leakage due to abnormal discharge or the like occurs.

The logarithm (LogR) of an amount of change in surface resistance of the secondary transfer roller (the external roller) 308 or the internal roller 304 is set to 0.05 or more. Therefore, it is possible to prevent occurrence of transfer failure due to an increase in roller potential and prevent occurrence of white spot due to spot-like discharge. Note that, when the logarithm (LogR) of an amount of change in surface resistance of the secondary transfer roller (the external roller) 308 or the internal roller 304 is set to 0.05 or less, surface resistance falls and white spot is caused by occurrence of spot-like discharge.

Moreover, the surface high-resistance layer is provided in one of the secondary transfer roller (the external roller) 308 and the internal roller 304 having lower resistance (in the example in FIG. 3, the surface high-resistance layer 308*b* is provided in the secondary transfer roller (the external roller) 308). In this way, since the surface high-resistance layer is provided in a roller with low resistance, it is possible to manufacture a roller having stable resistance and reduce occurrence of white spot.

In general, with low resistance control in which resistance of a roller is 6 or less in logarithm (LogR), it is possible to manufacture a roller that is simple and stable and has no fluctuation. On the other hand, when the resistance increases to medium resistance, resistance control is difficult, fluctuation increases, and cost for manufacturing and quality management increases. Therefore, resistance control for a roller consisting of a medium resistance rubber layer and a medium resistance (higher resistance) surface layer is more difficult.

Thus, the surface high-resistance layer is provided in the secondary transfer roller (the external roller) 308 or the internal roller 304 having lower resistance that can be manufactured stably. Consequently, it is possible to obtain a roller with resistance controlled stably and reduce occurrence of white spot.

Figure 4:
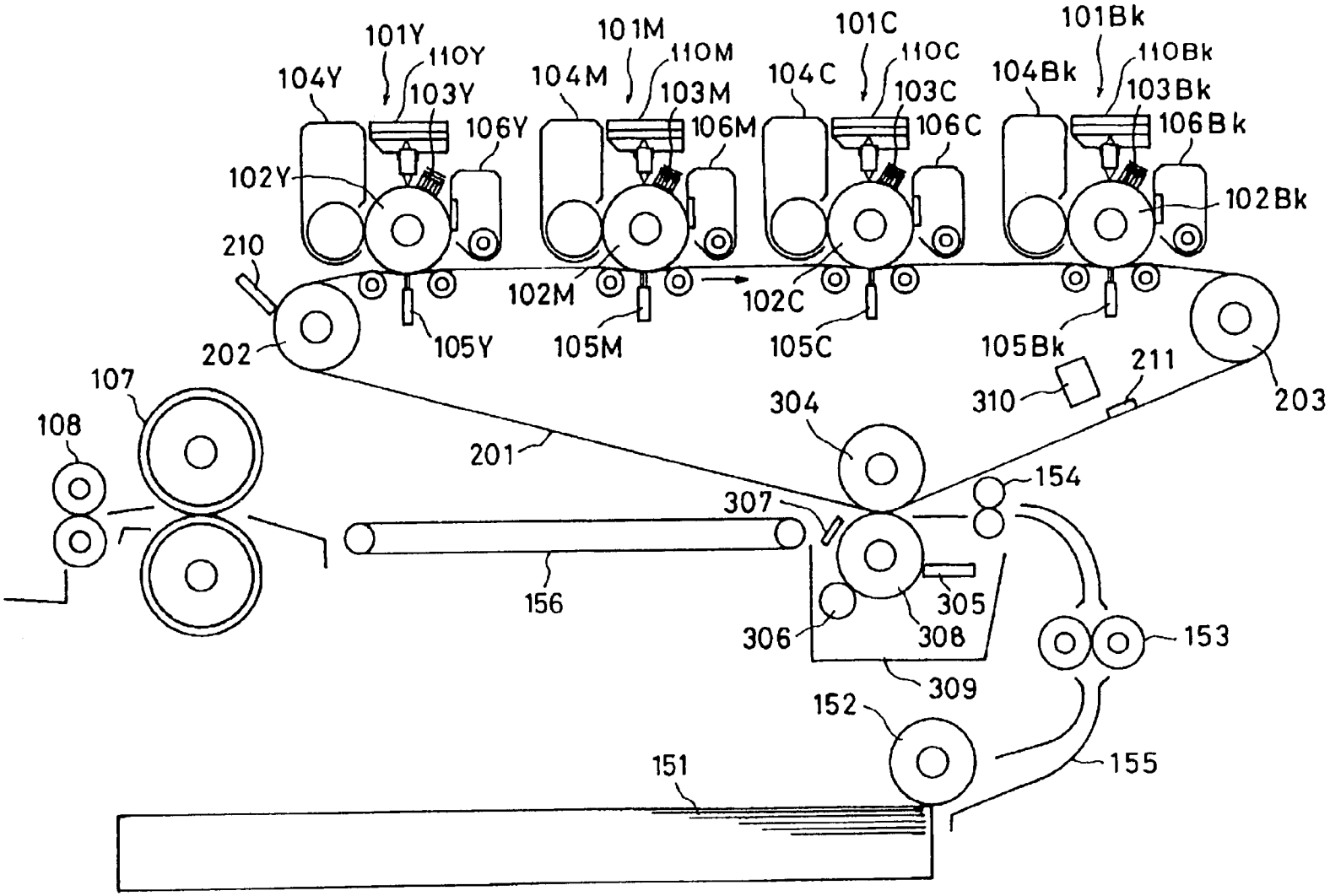
FIG. 4 is a schematic of an image forming apparatus according to a second embodiment of the present invention.

FIG. 4 is a schematic of an image forming apparatus according to a second embodiment of the present invention.

The image forming apparatus is of a tandem type indirect transfer system in which the plurality of image forming units 101Y to 101Bk are disposed in parallel along the intermediate transfer member 201 is described. The transfer device including the intermediate transfer member of an endless belt shape (the intermediate transfer belt) 201 is provided in the center of this image forming apparatus. The intermediate transfer member 201 is wound around a plurality of support rollers and is rotationally conveyable clockwise in the figure.

Figure 5:
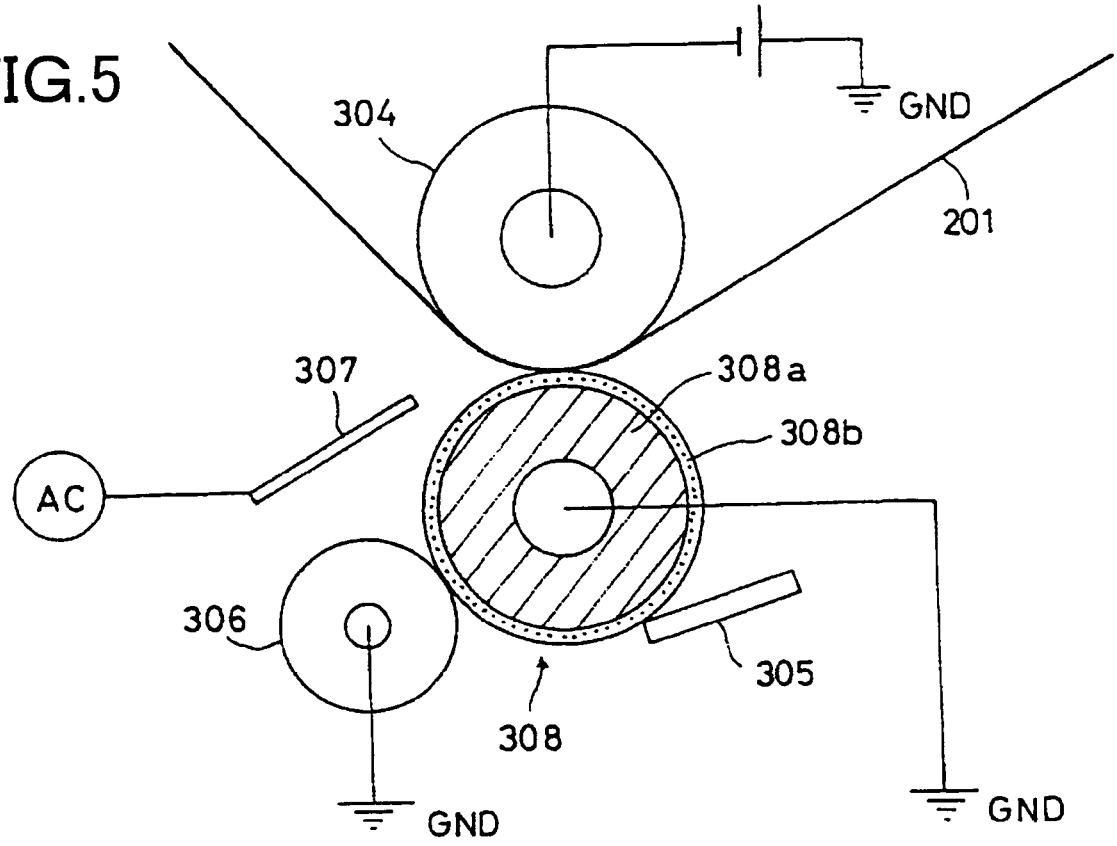
FIG. 5 is a schematic of an example of a constitution of a secondary transfer unit in the image forming apparatus shown in FIG. 4.

A basic constitution and a basic operation of the image forming apparatus in this embodiment are the same as those of the image forming apparatus in the first embodiment described above (FIGS. 1 to 3). Therefore, the constitution and the operation are not explained here. In this embodiment, a constitution of a secondary transfer unit 309 is different from the secondary transfer unit in the first embodiment. As shown in FIGS. 4 and 5, rotatable charge eliminating means, for example, a charge eliminating member 306 consisting of an electrically conductive brush or roller is provided on an upstream side of a cleaning blade 305 in a rotating direction of the secondary transfer roller (the external roller) 308. The charge eliminating member 306 is grounded. The charge eliminating member 306 is adapted to realize a paper powder removing effect and a charge eliminating effect for the secondary transfer roller 308. Consequently, the logarithm (LogR) of an amount of change in surface resistance of the secondary transfer roller 308 is set to 0.4 or more (resistance is increased) such that white spot does not occur.

The charge eliminating needle 307 is provided in the secondary transfer unit 309. An alternating current is applied to a recording medium (a transfer sheet, etc.) from a rear surface thereof by the charge eliminating needle 307 to neutralize accumulated charge (eliminate charge) of the recording medium.

Originally, an AC bias is applied to the charge eliminating needle 307 only when a recording medium is conveyed to the secondary transfer unit 309. However, in this embodiment, an AC bias is applied even when a recording medium is not conveyed to the secondary transfer unit 309 to cause the charge eliminating needle 307 to eliminate charge in non-contact with the secondary transfer roller 308.

In the transfer device and the image forming apparatus having the constitutions shown in FIGS. 4 and 5, both the surface hardness of the secondary transfer roller (the external roller) 308 and the surface hardness of the internal roller 304 are set to 50 degrees or more in the asker C scale. The logarithm (LogR) of volume resistivity of the intermediate transfer member 201 is set to 10.0 or less. Moreover, the logarithm (LogR) of combined resistance of the secondary transfer roller (the external roller) 308 and the internal roller 304 is set to 6.5 or more. The logarithm (LogR) of an amount of change in surface resistance of the secondary transfer roller (the external roller) 308 or the internal roller 304 is set to 0.4 or more. Charge eliminating means is provided in the roller.

Both the surface hardness of the external roller 308 and the surface hardness of the internal roller 304 are set to 50 degrees (in the asker C scale) or more and the logarithm (LogR) of volume resistivity of the intermediate transfer member 201 is set to 10.0 or less. Consequently, a stable transfer image without a problem of a residual image due to residual potential of the intermediate transfer member 201 is obtained. It is possible to use the blade 305 for surface cleaning for the secondary transfer roller (the external roller) 308. Therefore, compared with the electrostatic cleaning system, it is unnecessary to provide an approaching/separating mechanism. High-performance cleaning, which does not require a user to take into account timing for cleaning, is realized. Note that, when surface hardness falls to 50 degrees or less in the asker C scale, a cleaning blade easily cuts into a roller surface because of abutment of the cleaning blade, making it impossible to obtain a proper cleaning angle. As a result, cleaning failure tends to occur.

However, on the other hand, in the transfer device using a roller having high surface hardness, transfer failure tends to occur because of a reduction in the transfer nip and non-uniformity of a transfer pressure. Thus, a transfer voltage is increased for improvement of a transfer property.

In addition, when sheet resistance increases because of a low humidity environment or at the time of rear side copying in duplex copying or the like, the transfer voltage increases more. As a result, it is likely that spot-like discharge occurs in a solid image portion and white void (white spot) with a diameter of about 0.1 to 0.3 millimeter occurs.

Combined resistance of the secondary transfer roller (the external roller) 308 and the internal roller 304 is important in designing a transfer system. If the logarithm (LogR) of combined resistance is 6.5 or less, an electric current that flows to a recording medium changes depending on the size of the recording medium.

When the recording medium is small, such as A5 size, an electric current tends to flow directly from the secondary transfer roller 308 to a non-paper-passing section of the intermediate transfer member 201. Since a required effective transfer electric field is not obtained, transfer failure tends to occur in an image. Thus, the logarithm (LogR) of combined resistance is set to 6.5 or more. Consequently, even if a small-size recording medium is used, since an electric current flowing to the non-paper-passing section does not increase excessively, an appropriate transfer electric field is obtained and a satisfactory image is obtained.

In a roller such as the secondary transfer roller 308 shown in FIG. 5 in which the surface of the rubber layer 308*a* is coated with the high-resistance thin layer 308*b*, resistance of a surface of the roller has been conventionally measured according to surface resistance measurement. However, since measurement of surface resistance includes measurement of rubber layer resistance, it is impossible to measure surface layer resistance correctly.

Surface layer material coating may be applied to a metal plate to perform property management according to surface resistivity and volume resistivity. However, resistance of the thin layer coated on the roller surface and resistance of the thin layer coated on the metal plate are not always identical. This causes fluctuation in resistance of the roller surface.

It is know that it is possible to evaluate resistance of a surface thin layer correctly according to an amount of change in surface resistance.

When the logarithm (LogR) of an amount of change in surface resistance of the secondary transfer roller (the external roller) 308 is 0.4 or more, an effect of prevention of white spot is high. However, the residual potential increases because of an increase in surface layer resistance and the transfer property deteriorates successively because of continuous copying (printing).

Thus, the charge eliminating means (the charge eliminating member 306 or the charge eliminating needle 307) for eliminating charge of the secondary transfer roller (the external roller) 308 is provided. Consequently, even if the logarithm (LogR) of an amount of change in surface resistance is set to 0.4 or more, the deterioration of the transfer property due to an increase in roller potential does not occur and it is possible to prevent spot-like discharge and occurrence of white spot.

The logarithm (LogR) of combined resistance of the secondary transfer roller (the external roller) 308 and the internal roller 305 is set to 6.5 or more and the logarithm (LogR) of an amount of change in surface resistance is set to 0.4 or less. In addition, the charge eliminating means (the charge eliminating member 306 or the charge eliminating needle 307) is provided. Consequently, transfer failure due to a sheet size does not occur and it is possible to prevent occurrence of spot-like discharge during sheet transfer and reduce occurrence of white spot in a toner image.

The charge eliminating member 306 consisting of an electrically conductive brush or roller is used as the charge eliminating means. Since such a charge eliminating member 306 is used as the charge eliminating means, a charge eliminating effect is obtained with a simple constitution. In addition, it is possible to prevent deterioration of a transfer property due to an increase in residual potential of the secondary transfer roller 308 or the internal roller 304 and prevent occurrence of white spot.

It is possible to use the charge eliminating needle 307 arranged in non-contact with the secondary transfer roller 308 or the internal roller 304 as the charge eliminating means. Since charge elimination is performed by the charge eliminating needle 307 arranged in non-contact with the secondary transfer roller 308 or the internal roller 304, it is possible to eliminate charge without damaging the secondary transfer roller 308 or the internal roller 304.

In addition, an alternating current is applied to the charge eliminating means. Thus, it is possible to obtain a higher charge eliminating effect.

Specific practical examples of the present invention and comparative examples are described below.

First, practical examples corresponding to the constitution in the first embodiment (FIGS. 1 to 3) and comparative examples are described.

Figure 6:
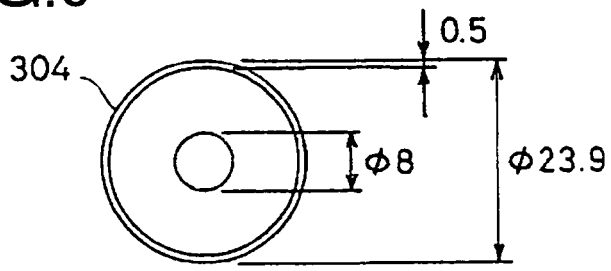
FIG. 6 is a schematic of an example of an internal roller used in a transfer device according to a third embodiment of the present invention.

The internal roller 304 in one practical example is formed by coating a roller made of aluminum with NBR rubber having thickness of 0.5 millimeter. As shown in FIG. 6, the internal roller 304 has a shaft diameter of 8 millimeters and an external diameter of 23.9 millimeters. In addition, the internal roller 304 has resistance of 7.5(LogR)/500V and surface hardness of 55 degrees (in the asker C scale).

The secondary transfer roller (the external roller) 308 is formed by coating an aluminum cored bar having a diameter of 16 millimeters with NRB rubber as the rubber layer 308*a* and coating a surface of the rubber layer 308*a* with fluorine-containing acrylic resin having thickness of 20 micrometers. Surface hardness of the secondary transfer roller 308 is 53 degrees (in the asker C scale).

A single-layer endless belt having thickness of 0.08 millimeter made of polyimide is used as the intermediate transfer member 201.

Table 1 below is a table comparing characteristics of comparative examples 1 to 8 and examples 1 to 20.

As image evaluation, white spot, a transferred image, a discharge image, and stain on a rear side of a sheet were evaluated as described below.

White Spot

Environment: A low temperature/low humidity environment (10° C., 15% RH)

Sheet: Sheet set in a thick paper mode such as 110 Kg paper (reducing fixing speed)

A Rear Side Image in Duplex Copying

Original: White spot was evaluated in a solid image and a halftone solid image portion.

Transferred Image

Charge-up (increase in residual potential) of a secondary transfer roller: Images on a first sheet and a tenth sheet in continuous copying were evaluated.

Transfer property of small size paper: It was evaluated how a solid portion toner image was filled with a toner in an A3 size image and an A5 size image.

Discharge Image

A discharge image was evaluated according to partial irregularity of a toner image in a solid portion and a halftone portion.

Stain on a Rear Side of a Sheet

Stain on a rear side of a sheet of 100 images continuously printed was evaluated.

TABLE 1

| | Volume resistance of intermediate transfer belt | Combined resistance on inner and outer side | Change in roller surface resistance | Roller surface hardness | Occurrence of White spot | Transferred image | Discharge image | Stain on a rear side of a sheet |
|---|---|---|---|---|---|---|---|---|
| Comparative example 1 | 7.2 | 6.1 | 0 | 40 | X | X (HH. A5 size) | ○ | X |
| Comparative example 2 | 7.2 | 6.1 | 0.5 | 40 | ○ | X (HH. A5 size) | ○ | X |
| Comparative example 3 | 7.2 | 9.4 | 0 | 40 | X | Δ | ○ | X |
| Comparative example 4 | 7.2 | 9.4 | 0.5 | 40 | ○ | Δ | ○ | X |
| Comparative example 5 | 10.8 | 6.1 | 0 | 40 | X | X (HH. A5 size) | Δ | X |
| Comparative example 6 | 10.8 | 6.1 | 0.5 | 40 | ○ | X (HH. A5 size) | Δ | X |
| Comparative example 7 | 10.8 | 9.4 | 0 | 40 | X | X (LL) | X | X |
| Comparative example 8 | 10.8 | 9.4 | 0.5 | 40 | ○ | X (LL) | X | X |
| Example 1 | 7.8 | 6.6 | 0.06 | 55 | Δ | Δ○ (HH. A5 size) | ○ | ○ |
| Example 2 | 7.8 | 6.6 | 0.06 | 90 | Δ | Δ○ (HH. A5 size) | ○ | ○ |
| Example 3 | 7.8 | 6.6 | 0.37 | 55 | ○ | Δ○ (HH. A5 size) | ○ | ○ |
| Example 4 | 7.8 | 6.6 | 0.37 | 90 | ○ | Δ○ (HH. A5 size) | ○ | ○ |
| Example 5 | 7.8 | 8.8 | 0.06 | 55 | ○ | ○ | ○ | ○ |
| Example 6 | 7.8 | 8.8 | 0.06 | 90 | ○ | ○ | ○ | ○ |
| Example 7 | 7.8 | 8.8 | 0.37 | 55 | ○ | ○ | ○ | ○ |
| Example 8 | 7.8 | 8.8 | 0.37 | 90 | ○ | ○ | ○ | ○ |
| Example 9 | 9.5 | 6.6 | 0.06 | 55 | ○ | Δ○ (HH. A5 size) | ○ | ○ |
| Example 10 | 9.5 | 6.6 | 0.06 | 90 | ○ | Δ○ (HH. A5 size) | ○ | ○ |
| Example 11 | 9.5 | 6.6 | 0.37 | 55 | ○ | Δ○ (HH. A5 size) | ○ | ○ |
| Example 12 | 9.5 | 6.6 | 0.37 | 90 | ○ | Δ○ (HH. A5 size) | ○ | ○ |
| Example 13 | 9.5 | 8.8 | 0.06 | 55 | ○ | ○ | ○ | ○ |
| Example 14 | 9.5 | 8.8 | 0.06 | 90 | ○ | ○ | ○ | ○ |
| Example 15 | 9.5 | 8.8 | 0.37 | 55 | ○ | ○ | ○ | ○ |
| Example 16 | 9.5 | 8.8 | 0.37 | 90 | ○ | ○ | ○ | ○ |
| Example 17 | 8.5 | 7.5 | 0.39 | 55 | ○ | Δ | ○ | ○ |
| Example 18 | 8.5 | 7.5 | 0.33 | 55 | ○ | ○ | ○ | ○ |
| Example 19 | 8.5 | 7.5 | 0.13 | 55 | ○ | ○ | ○ | ○ |
| Example 20 | 8.5 | 7.5 | 0.25 | 55 | ○ | ○ | ○ | ○ |

Note that all of the volume resistance of an intermediate transfer belt, the combined resistance on an inner side and an outer side, and the amount of change in a roller surface resistance are represented in the logarithm (LogR).

As it is evident from Table 1, in the examples 1 to 20 in which the conditions explained in the first embodiment are satisfied, all results of the image evaluation (white spot, a transferred image, a discharge image, and stain on a rear side of a sheet) are indicated as fair or good. Reduction in occurrence of white spot, improvement of an image quality, and prevention of stain on a rear side of a sheet are attained. On the other hand, in the comparative examples 1 to 8, some results of the image evaluation (white spot, a transferred image, a discharge image, and stain on a rear side of a sheet) are indicated as bad.

A measurement method used in the evaluation is as described below.

Roller Resistance

Figure 7:
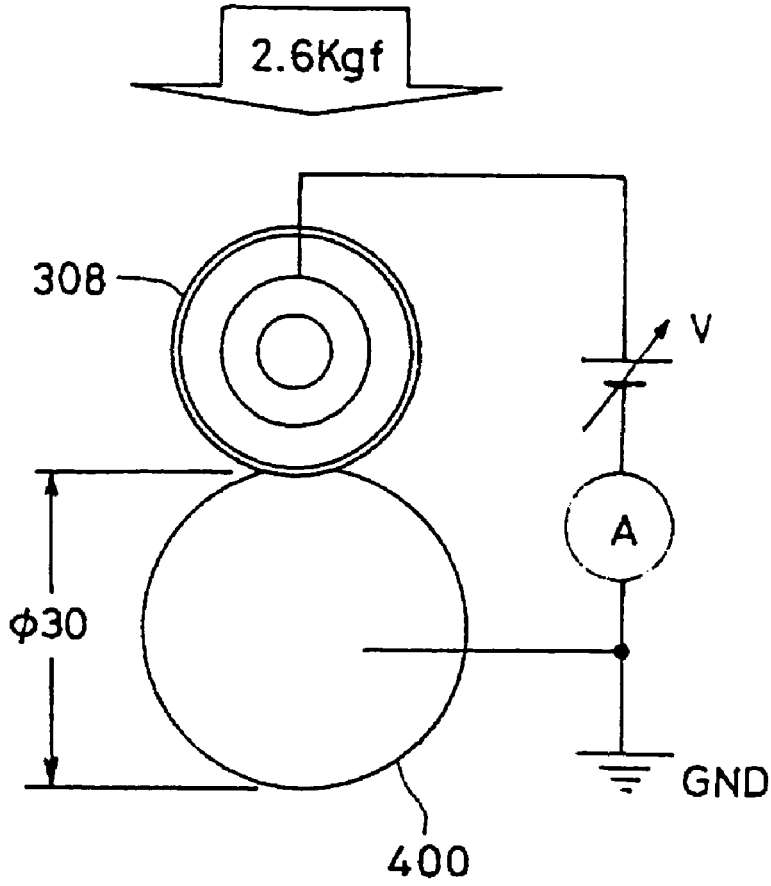
FIG. 7 is a schematic for explaining a method of measuring roller resistance.

As shown in FIG. 7, a measurement roller (e.g., the transfer roller 308) is pressed on a metal roller 400 at a fixed pressure. A DC power supply and an ampere meter are connected between the metal roller 400 and the measurement roller 308. A constant voltage is applied between the metal roller 400 and the measurement roller 308 to calculate resistance from an electric current. As measurement conditions, a voltage is set to 500 volts (a constant voltage), an applied pressure is set to 2.6 Kgf, and measurement time is set to a 5 sec value.

Measurement of Roller Surface Resistance

Figure 8:
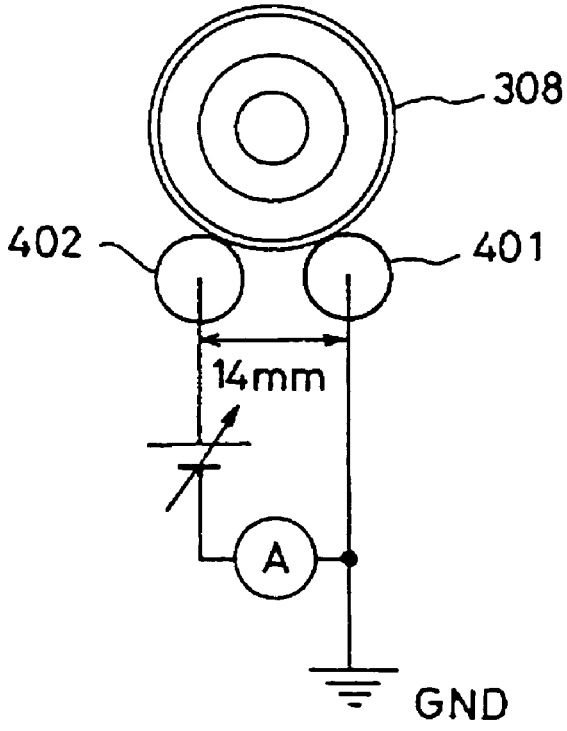
FIG. 8 is a schematic for explaining a method of measuring surface resistance of a roller.

As shown in FIG. 8, metal rollers 401 and 402 having a diameter of 8 millimeters are set in parallel at an interval of 14 millimeters in contact with the measurement roller (e.g., the transfer roller 308). A DC power supply and an ampere meter are connected between the metal rollers. A voltage of 200 volts is applied between the metal rollers to measure surface resistance from an electric current.

When surface resistivity is $\rho s(\Omega/\square)$, surface resistance is $R(\Omega)$, a length of the measurement roller is L (cm), and a distance between the metal rollers is d (cm), surface resistivity $\rho s$ is represented as $\rho s = R \times L/d$.

Measurement of Roller Surface Potential

Figure 9:
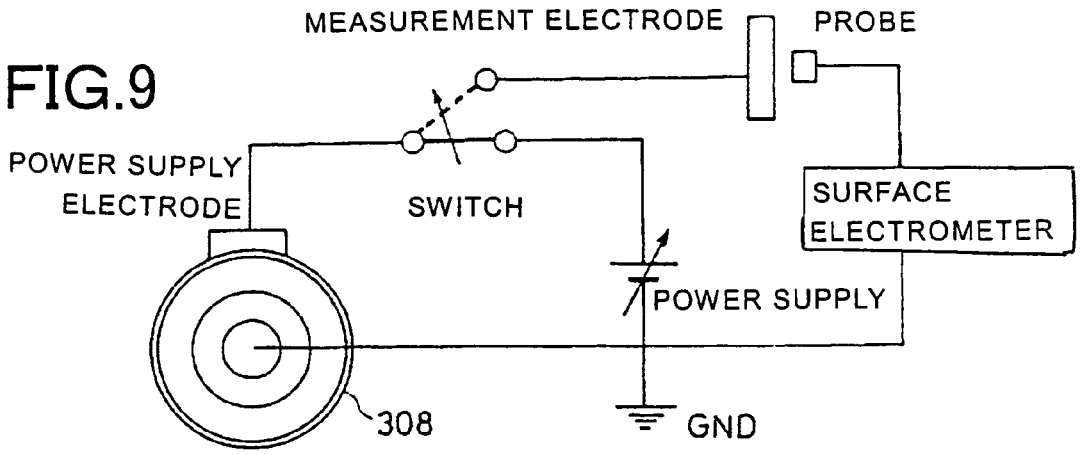
FIG. 9 is a schematic for explaining a method of measuring surface potential of a roller.

As shown in FIG. 9, a DC power supply is connected to a power supply electrode, which is in abutment against a surface of the measurement roller (e.g., the transfer roller 308), via a switch. A constant voltage (an applied voltage: 200 volts) is applied to the power supply electrode for a fixed time (application time: 10 seconds) by a power supply. After the constant voltage is applied to the power supply electrode for the fixed time, the switch is changed over to turn off the power supply and connect the power supply electrode with a measurement electrode. Consequently, potential same as that on the roller surface is induced in the power supply electrode, which is in contact with the roller surface, and the measurement electrode. Thus, the potential at the measurement electrode is measured by a surface electrometer.

Measurement of Volume Resistance of Intermediate Transfer Belt

Volume resistance of an intermediate transfer belt is measured at a measurement voltage of 100 volts and measurement time of a 10 sec value using Hirester UP (manufactured by Mitsubishi Chemical Corporation) and a URS probe (which uses electrically conductive rubber).

Examples of results obtained by measuring volume resistance of an intermediate transfer belt are shown in FIGS. 10 to 13.

Figure 10:
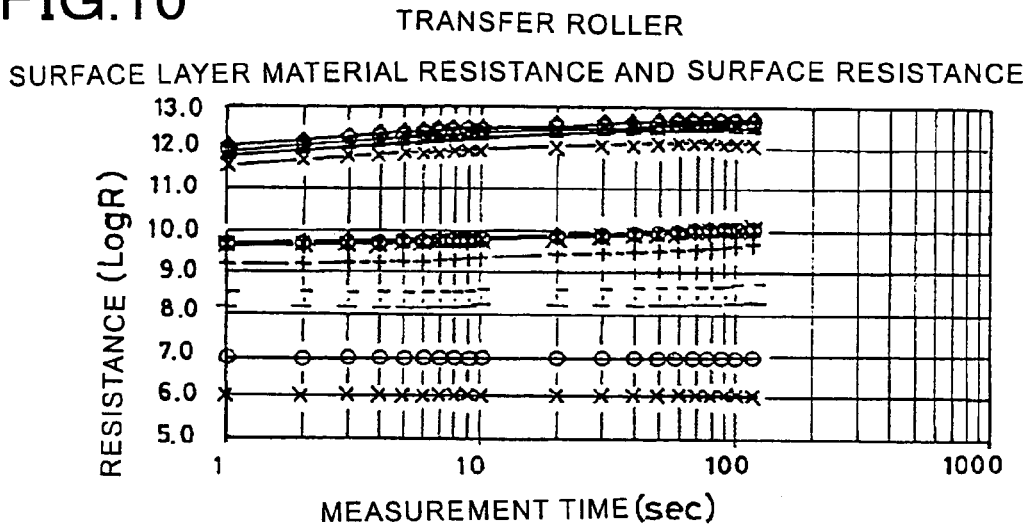
FIG. 10 is a graph of a result of measurement of surface resistance of a transfer roller at the time when resistance of a surface layer coating material is varied.

FIG. 10 is a graph of a result of measurement of surface resistance of a transfer roller at the time when resistance of a surface layer coating material is varied. Since rubber layer resistance is identical, the measurement result is a result of measuring surface resistance caused by surface layer resistance.

Figure 11:
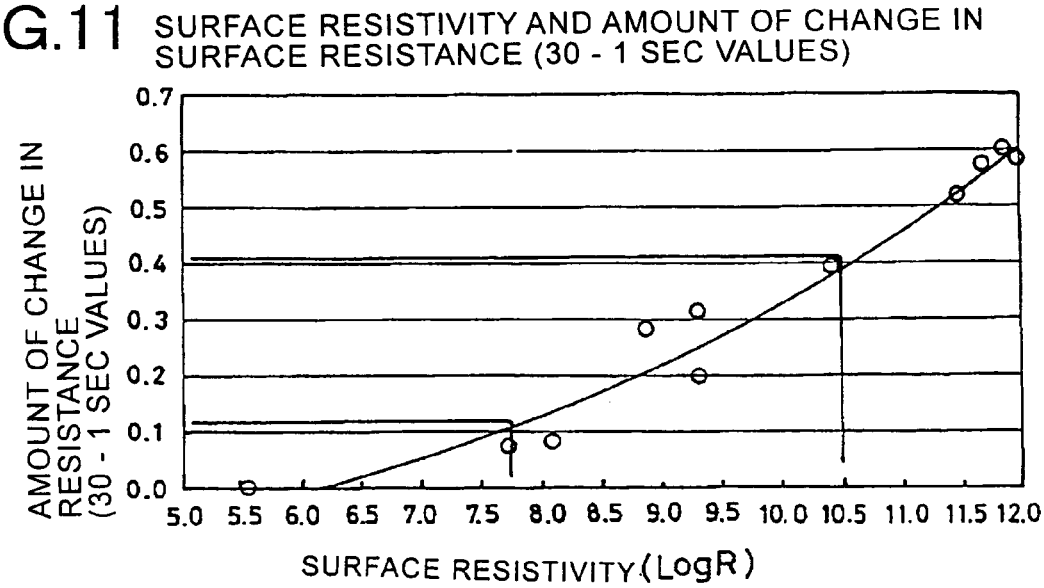
FIG. 11 is a graph in which an abscissa indicates surface resistance in a 10 sec value of a transfer roller and an ordinate indicates amounts of change of in 30 sec value and a 1 sec value.

FIG. 11 is a graph in which an abscissa indicates surface resistance in a 10 sec value of a transfer roller and an ordinate indicates amounts of change in a 30 sec value and a 1 sec value. It is seen that an amount of change in resistance changes according to surface resistivity. An amount of electric charge trapped on a surface layer interface varies according to surface material resistance, resulting in the amount of change in resistance.

Figure 12:
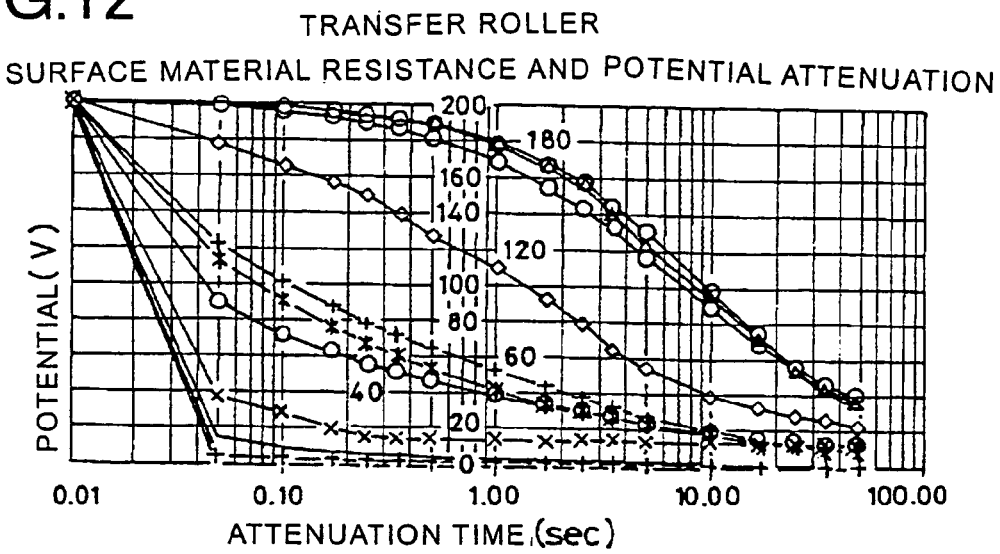
FIG. 12 is a graph of a result of measurement of surface potential attenuation of a transfer roller at the time when resistance of a surface coating material is varied.

FIG. 12 is a graph of a result of measurement of potential attenuation on a surface of a transfer roller at the time when resistance of a surface coating material is varied. Because of limitations of a measurement system, measurement is started 0.05 seconds after changing over the switch. For convenience of a logarithmic graph, a voltage is applied for 0.01 second. It is seen that attenuation speed of surface potential varies according to surface material resistance.

Figure 13:
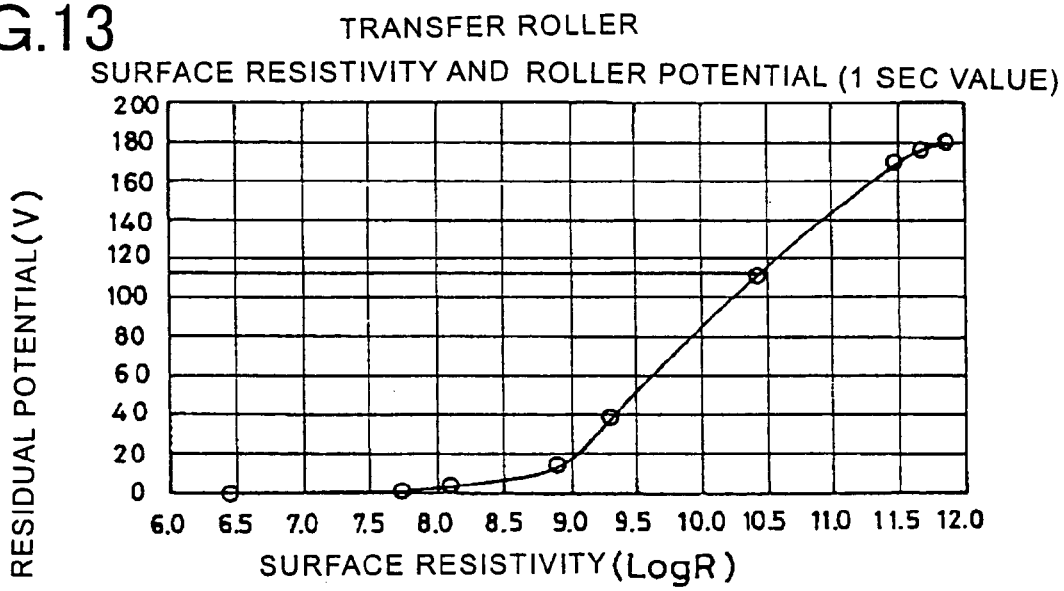
FIG. 13 is a graph in which an abscissa indicates surface resistance in a 10 sec value of a transfer roller and an ordinate indicates potential in 1 sec value.

FIG. 13 is a graph in which an abscissa indicates surface resistivity in a 10 sec value of a transfer roller and an ordinate indicates potential in 1 sec value. Residual potential increases in proportion to surface resistivity.

Examples corresponding to the constitution in the second embodiment and comparative examples are described below.

The internal roller 304 in the examples is formed by coating a roller made of aluminum with NBR rubber having thickness of 0.5 millimeter. As shown in FIG. 6, the internal roller 304 has a shaft diameter of 8 millimeters and an external diameter of 23.9 millimeters. In addition, the internal roller 304 has resistance of 7.5(LogR)/500V and surface hardness of 75 degrees (in the asker C scale).

The secondary transfer roller (the external roller) 308 is formed by coating an aluminum cored bar having a diameter of 16 millimeters with hydrin rubber as the rubber layer 308*a* and coating a surface of the rubber layer 308*a* with fluorine-containing acrylic resin having thickness of 20 micrometers. Surface hardness of the secondary transfer roller 308 is 70 degrees (in the asker C scale).

A single-layer endless belt having thickness of 0.08 millimeter made of polyimide is used as the intermediate transfer member 201.

Table 2 below is a table comparing characteristics of comparative examples 9 to 11 and an example 21.

A method of measuring roller surface resistance is the same as the method described above. An amount of change in roller surface resistance is represented in the logarithm (LogR).

As image evaluation, white spot and a transferred image were evaluated as described below.

White Spot

Environment: A low temperature/low humidity environment (10° C., 15% RH)

Sheet: Sheet set in a thick paper mode such as 110 Kg paper (reducing fixing speed)

A Rear Side Image in Duplex Copying

Original: White spot was evaluated in a solid image and a halftone solid image portion.

Transferred Image

Charge up (increase in residual potential) of a secondary transfer roller: Images on a first sheet and a tenth sheet in continuous copying were evaluated.

TABLE 2

| | An amount of change in roller surface resistance | Roller charge eliminating means | White spot | Transferred image |
|---|---|---|---|---|
| Comparative example 9 | 0 | absence | X | ○ |
| Comparative example 10 | 0.3 | absence | Δ | ○ |
| Comparative example 11 | 0.7 | absence | ○ | X |
| Example 21 | 0.6 | presence | ○ | ○ |

As it is evident from Table 2, in the example 21 in which the conditions explained in the second embodiment are satisfied, all results of the image evaluation (white spot and a transferred image) are indicated as good. Reduction in occurrence of white spot and improvement of an image quality of a transferred image are attained. On the other hand, in the comparative examples 9 and 11 in which charge eliminating means is not provided, some results of the image evaluation (white spot and a transferred image) are indicated as bad. In the comparative example 10, although charge eliminating means is not provided, an amount of change in roller surface resistance satisfies the conditions in the first embodiment. Thus, an evaluation result of fair or better is obtained.

Figure 14:
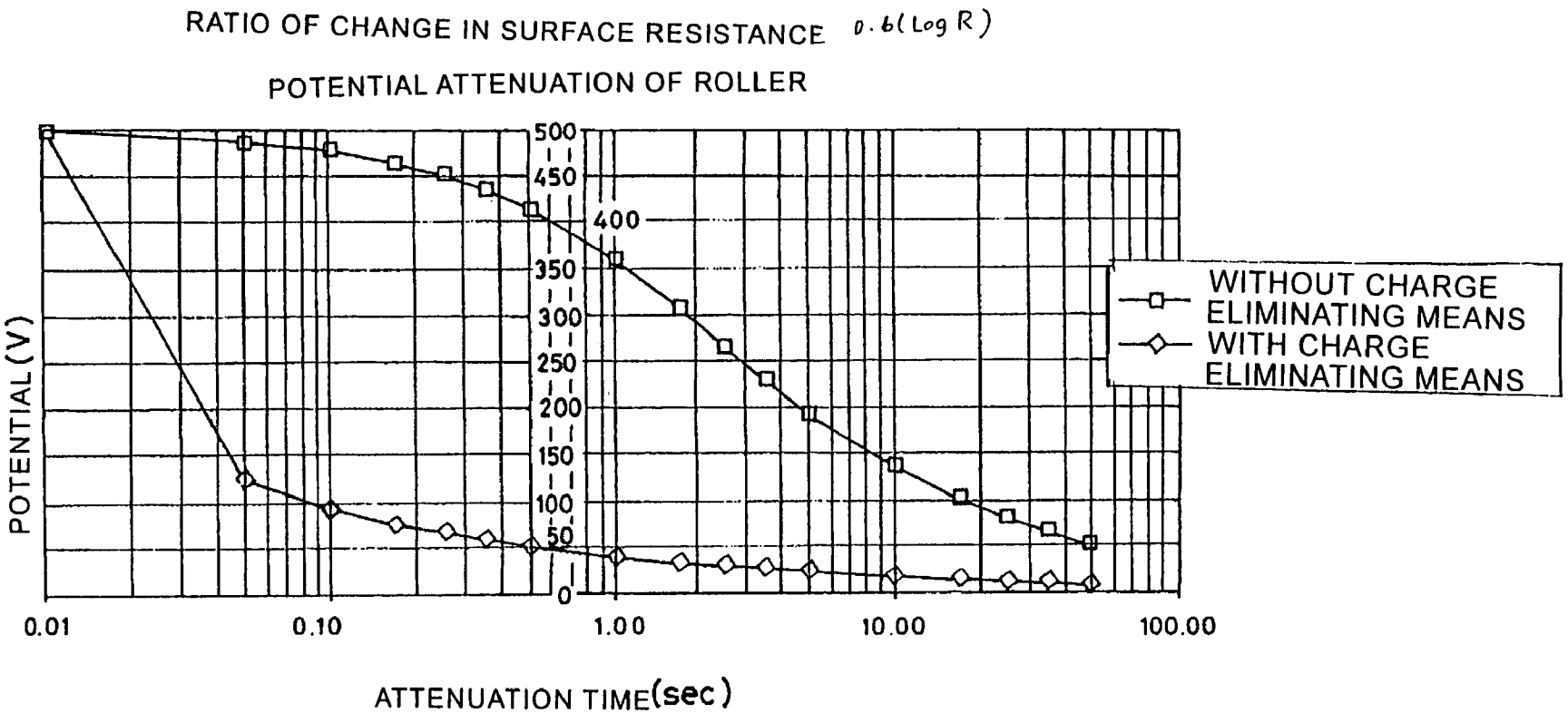
FIG. 14 is a graph of a result obtained by measuring potential attenuation on a roller surface according to presence or absence of charge eliminating means.

FIG. 14 is a graph of a result obtained by measuring potential attenuation on a roller surface due to presence or absence of charge eliminating means.

When charge eliminating means is not provided, as shown in FIG. 12, attenuation speed varies according to resistance of a surface layer material. Attenuation time is long in a roller having the logarithm (LogR) of an amount of change in resistance equal to or more than 0.4 (e.g., a roller having the logarithm (LogR) of an amount of change in resistance equal to 0.6). However, as shown in FIG. 14, attenuation time of roller potential is short in a roller including charge eliminating means. It is possible to prevent the roller from being subjected to charge-up to cause an increase in potential.

Thus, because the surface hardness of the external roller is set to 50 degrees or more in the asker C scale, it is possible to remove a residual toner on the external roller easily. Consequently, spot-like irregularity of an image due to a residual toner on the external roller is reduced.

Moreover, because surface hardness of the internal roller is set to 50 degrees or more in the asker C scale, it is possible to reduce fluctuation in speed of the intermediate transfer member in a transfer nip. Consequently, spot-like irregularity of an image due to fluctuation in speed of the intermediate transfer member in the transfer nip is reduced.

Furthermore, the logarithm (LogR) of volume resistivity of the intermediate transfer is set to 10.0 or less. Thus, it is possible to reduce residual potential of the intermediate transfer member. Consequently, it is possible to reduce spot-like irregularity of an image due to residual potential of the intermediate transfer member.

Moreover, the logarithm (LogR) of combined resistance of the external roller and the internal roller is set to 6.5 or more. Thus, even when a recording medium is small, an electric current flowing to a non-paper-passing section excessively, which is caused by setting the logarithm (LogR) of volume resistivity of the intermediate transfer member to 10.0 or less, never increases. Consequently, an appropriate transfer electric field and a satisfactory image are obtained.

Furthermore, the logarithm (LogR) of an amount of change in surface resistance of the external roller or the internal roller is set to 0.4 or less. Thus, it is possible to prevent spot-like discharge and occurrence of white spot. In particular, the logarithm (LogR) of combined resistance of the external roller and the internal roller is set to 6.5 or more and the logarithm (LogR) of an amount of change in surface resistance of the external roller or the internal roller is set to 0.4 or less. Thus, transfer failure due to a sheet size does not occur. In addition, it is possible to prevent occurrence of spot-like discharge during sheet transfer and reduce white spot in a toner image.

Moreover, the logarithm (LogR) of volume resistivity of the intermediate transfer member is set to 7.5 or more. Thus, it is possible to prevent occurrence of transfer failure due to an increase in residual potential and further reduce occurrence of white spot.

Furthermore, the logarithm (LogR) of combined resistance of the external roller and the internal roller is set to 9.0 or less. Thus, it is possible to prevent an increase in a transfer voltage, insufficiency of a power supply voltage, and leakage due to a high voltage and reduce occurrence of white spot.

Moreover, the logarithm (LogR) of an amount of change in surface resistance of the external roller or the internal roller is set to 0.05 or more. Thus, it is possible to prevent occurrence of transfer failure due to an increase in roller potential and occurrence of white spot due to spot-like discharge.

Furthermore, the surface high-resistance layer is provided in one of the external roller and the internal roller having lower resistance. Thus, it is possible to manufacture a roller having stable resistance and reduce occurrence of white spot.

Moreover, the logarithm (LogR) of an amount of change in surface resistance of the external roller or the internal roller is set to 0.4 or more and charge eliminating means is provided in the external roller or the internal roller. Thus, transfer failure due to a sheet size does not occur. In addition, it is possible to prevent occurrence of spot-like discharge during sheet transfer and reduce white spot in a toner image.

Furthermore, an electrically conductive brush or roller is used as the charge eliminating means. Thus, a charge eliminating effect is obtained with a simple constitution. In addition, it is possible to prevent deterioration of a transfer property due to an increase in residual potential of the external roller or the internal roller and prevent occurrence of white spot.

Moreover, a charge eliminating needle arranged in non-contact with the external roller or the internal roller is used as the charge eliminating means. Thus, it is possible to eliminate charge without damaging the external roller or the internal roller. In addition, it is possible to prevent deterioration of a transfer property due to an increase in residual potential of the external roller or the internal roller and prevent occurrence of white spot.

Furthermore, an alternating current is applied to the charge eliminating means. Thus, it is possible to obtain a higher charge eliminating effect.

Moreover, the transfer device having any one of the effects described above is provided as transfer means. Thus, it is possible to reduce occurrence of white spot and obtain high quality images steadily.

Furthermore, a plurality of image forming units having image bearing members and image forming means for forming a toner image on the image bearing members are disposed along the intermediate transfer member. Thus, it is possible to form a color image by forming toner images of different colors with the image forming units and transferring the toner images onto the intermediate transfer member such that the toner images are superimposed one on top of another. In addition, it is possible to obtain high quality color images steadily.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device comprising:

a loop-shaped intermediate transfer member configured to hold a toner image, wherein a logarithm (LogR) of volume resistivity of the intermediate transfer member is 10.0 or less;

an external roller that is arranged outside of a loop of the intermediate transfer member and that is configured to hold a recording medium in cooperation with the intermediate transfer member, wherein a surface hardness of the external roller is 50 degrees or more in an asker C scale; and an internal roller that is arranged inside of the loop of the intermediate transfer member and that is configured to hold the intermediate transfer member in cooperation with the external roller, wherein a surface hardness of the internal roller is 50 degrees or more in an asker C scale, a surface resistance of the external roller is lower than that of the internal roller, and the external roller includes a layer of high resistance.

2. A transfer device comprising:

a loop-shaped intermediate transfer member configured to hold a toner image, wherein a logarithm (LogR) of volume resistivity of the intermediate transfer member is 10.0 or less;

an external roller that is arranged outside of a loop of the intermediate transfer member and that is configured to hold a recording medium in cooperation with the intermediate transfer member, wherein a surface hardness of the external roller is 50 degrees or more in an asker C scale; and an internal roller that is arranged inside of the loop of the intermediate transfer member and that is configured to hold the intermediate transfer member in cooperation with the external roller, wherein a surface hardness of the internal roller is 50 degrees or more in an asker C scale, a surface resistance of the internal roller is lower than that of the external roller, and the internal roller includes a layer of high resistance.

3. An image forming apparatus comprising:

an image forming unit that includes an image bearing member configured to hold a toner image and an image forming member configured to form a toner image on the image bearing member;

a transfer unit that transfers a toner image from the image bearing member onto a recording medium; and a fixing unit that fixes the toner image on the recording medium, wherein the transfer unit includes a loop-shaped intermediate transfer member configured to hold the toner image held by the image bearing member, wherein a logarithm (LogR) of volume resistivity of the intermediate transfer member is 10.0 or less, an external roller that is arranged outside of a loop of the intermediate transfer member and that is configured to hold a recording medium in cooperation with the intermediate transfer member, wherein a surface hardness of the external roller is 50 degrees or more in an asker C scale, and an internal roller that is arranged inside of the loop of the intermediate transfer member and that is configured to hold the intermediate transfer member in cooperation with the external roller, wherein a surface hardness of the internal roller is 50 degrees or more in an asker C scale, a surface resistance of the external roller is lower than that of the internal roller, and the external roller includes a layer of high resistance.

4. The image forming apparatus according to claim 3, wherein a plurality of the image forming units are disposed along the intermediate transfer member, and each image forming unit is configured to form a toner image of a specific color.

5. An image forming apparatus comprising:

an image forming unit that includes an image bearing member configured to hold a toner image and an image forming member configured to form a toner image on the image bearing member;

a transfer unit that transfers a toner image from the image bearing member onto a recording medium; and a fixing unit that fixes the toner image on the recording medium, wherein the transfer unit includes a loop-shaped intermediate transfer member configured to hold the toner image held by the image bearing member, wherein a logarithm (LogR) of volume resistivity of the intermediate transfer member is 10.0 or less, an external roller that is arranged outside of a loop of the intermediate transfer member and that is configured to hold a recording medium in cooperation with the intermediate transfer member, wherein a surface hardness of the external roller is 50 degrees or more in an asker C scale, and an internal roller that is arranged inside of the loop of the intermediate transfer member and that is configured to hold the intermediate transfer member in cooperation with the external roller, wherein a surface hardness of the internal roller is 50 degrees or more in an asker C scale, a surface resistance of the internal roller is lower than that of the external roller, and the internal roller includes a layer of high resistance.

6. The image forming apparatus according to claim 3, wherein a plurality of the image forming units are disposed along the intermediate transfer member, and each image forming unit is configured to form a toner image of a specific color.

7. A transfer device comprising:

a loop-shaped intermediate transfer member configured to hold a toner image, wherein a logarithm (LogR) of volume resistivity of the intermediate transfer member is 10.0 or less;

an external roller that is arranged outside of a loop of the intermediate transfer member and that is configured to hold a recording medium in cooperation with the intermediate transfer member, wherein a surface hardness of the external roller is 50 degrees or more in an asker C scale; and an internal roller that is arranged inside of the loop of the intermediate transfer member and that is configured to hold the intermediate transfer member in cooperation with the external roller, a surface hardness of the internal roller is 50 degrees or more in an asker C scale, a logarithm (LogR) of combined resistance of the external roller and the internal roller is 9.0 or less, and a surface resistance of the external roller is lower than that of the internal roller, and the external roller includes a layer of high resistance.

8. The transfer device of claim 2, wherein:

a logarithm (LogR) of combined resistance of the external roller and the internal roller is 9.0 or less.

9. The transfer device of claim 2 further comprising:

a charge eliminating unit that de-charges any one of the external roller and the internal roller.

10. The transfer device according to claim 9, wherein the charge eliminating unit includes an electrically conductive brush.

11. The transfer device according to claim 9, wherein the charge eliminating unit includes an electrically conductive roller.

12. The transfer device according to claim 9, wherein the charge eliminating unit includes a needle, wherein the needle does not contact with the external roller or the internal roller.

13. The transfer device according to claim 9, further comprising an alternating current applying unit configured to apply an alternating current to the charge eliminating unit.

* * * * *